United States Patent [19]

Moore et al.

[11] 4,426,821

[45] Jan. 24, 1984

[54] TRIANGULAR FACED POLYHEDRALS FORMED FROM END INTERCONNECTED FOLDED SHEET TRUSSES

[76] Inventors: Wayne T. Moore, 3522 Whitney Dr., Carrollton, Tex. 75007; Oscar F. Jones, Jr., 1308 Brownwood Dr., Carrollton, Tex. 75006

[21] Appl. No.: 137,771

[22] Filed: Apr. 7, 1980

[51] Int. Cl.[3] ..... E04H 12/18

[52] U.S. Cl. ..... 52/646; 52/732; 52/DIG. 10; 46/31; 434/211

[58] Field of Search ..... 52/732, DIG. 10, 631, 52/640, 646; 46/23, 31; 434/211, 403

[56] References Cited

U.S. PATENT DOCUMENTS

| | | | |
|---|---|---|---|
| 1,198,524 | 9/1916 | Cunliffe | 46/31 X |
| 2,920,846 | 1/1958 | Lingafelter | 404/35 X |
| 3,120,078 | 2/1964 | Bessinger | 52/DIG. 10 X |
| 3,305,255 | 2/1967 | Henderson | 52/631 X |
| 3,769,772 | 11/1973 | Oetiker | 52/646 |
| 4,212,130 | 7/1980 | Walker | 52/DIG. 10 X |

*Primary Examiner*—Carl D. Friedman
*Attorney, Agent, or Firm*—Warren H. Kintzinger

[57] ABSTRACT

A structural element in rectangular form folded along its longitudinal center forming a truss element in triangular faced polyhedrals when end edges of the structured element are connected to the corresponding adjacent, respective, end edges of like structural elements in an assembled polyhedral. The fold in the structural element assumes a dihedral angle well under 180°, approximating 110°, with the truss element used in forming a four triangular faced tetrahedron, 90° with the truss element used in a cube, although this is an unstable structure in not presenting the structural shape integrity attained inherently with truss elements used in triangularly faced polyhedrals. Further, the structural element assumes a dihedral angle approximating 75° with the truss element used in forming an eight triangular faced octahedron, and approximately a 42° fold in the truss elements forming a twenty triangular faced icosahedron.

6 Claims, 7 Drawing Figures

TRIANGULAR FACED POLYHEDRALS FORMED FROM END INTERCONNECTED FOLDED SHEET TRUSSES

Figure 1:
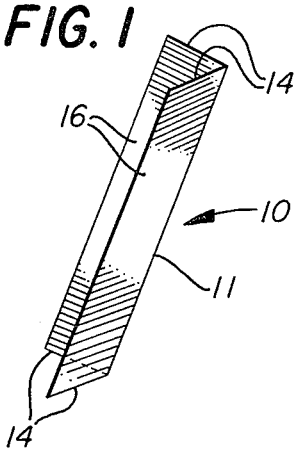

This invention relates in general to built-up structures having duplicate element trusses and, in particular, to triangular faced polyhedrals formed from end interconnected substantially identically duplicated folded rectangular sheet trusses.

The rectangular longitudinally folded sheet truss element presented is quite useful in the construction of various geometric shapes in three dimensions, space trusses and geodesic designs. This is with, generally, the truss elements movably bendable about the fold crease to adapt to the various fold angles consistent with various structured polyhedral build-ups. If a particular polyhedral build-up is predetermined then for specific instances, the fold creased truss elements could be supplied with a specific included angle crease. These truss elements are quite useful in educational game devices, used in teaching building principles for various structural shapes and to illustrate mathematical concepts to students studying plane and solid geometry. Further, the folded rectangular sheet truss elements illustrate how, when properly interconnected, folded element end edge to respective folded element end edge, assembled three dimensional geometric structures, particularly having triangular faces, present optimized structural shape integrity. This is useful in the attainment of geometric shapes having optimized structural strength-to-weight ratios, and in some such forms useful for structural purposes other than just for educational purposes.

It is, therefore, a principal object of this invention to provide a new and useful folded sheet truss used in end edge interconnected form to build up three-dimensional polyhedrals.

Another object is to provide a basic building element useful as an educational tool in illustrating various mathematic and construction principles.

A further object is to provide various polyhedral built-up structures having optimal strength-to-weight characteristics.

Features of this invention useful in accomplishing the above objects include a basic rectangular sheet longitudinally folded structural truss element used in the build-up of various polyhedral geometric three-dimensional shapes with folded end edge to folded end edge interconnection in various combinations for the respective geometric shapes built up. The fold in the structural element assumes a dihedral angle well under 180°, approximating 110°, with the truss element used in forming a four triangular faced tetrahedron, 90° with the truss element used in a cube, although this is an unstable structure in not presenting the structural shape integrity attained inherently with truss element used in triangularly faced polyhedrals. Further, the structural element assumes a dihedral angle approximating 75° with the truss element used in forming an eight triangular faced octahedron, and approximately a 42° fold in the truss elements forming a twenty triangular faced icosahedron. If the folded structural truss element is flexible at the fold, one basic truss element may be used for the various polyhedrals mentioned and even polyhedrals with more triangular faces with, however, the included dihedral angle becoming progressively smaller by steps with each step-up in the number of faces in a closed polyhedral structure.

Specific embodiments representing what are presently regarded as the best modes of carrying out the invention are illustrated in the accompanying drawings.

Figure 1A:
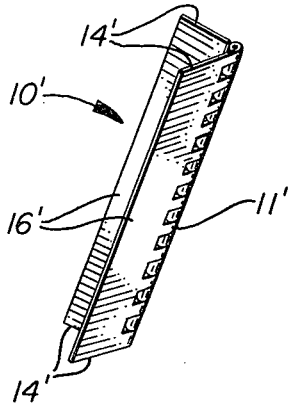
Figure 2:
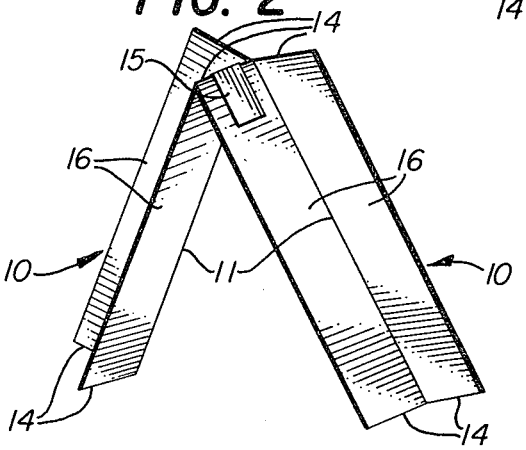
Figure 2A:
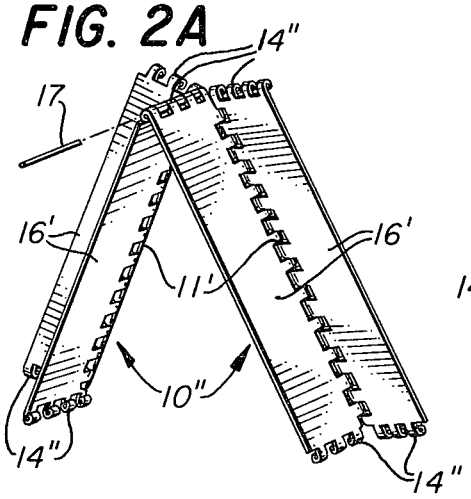
Figure 3:
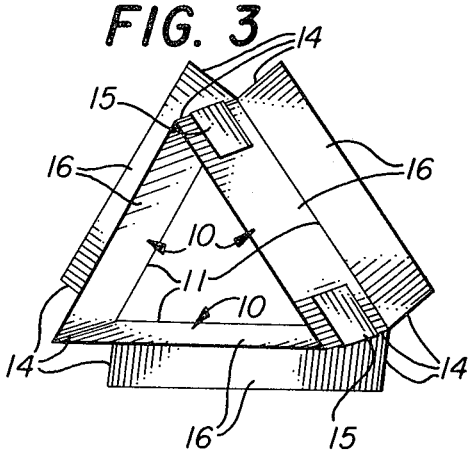
Figure 4:
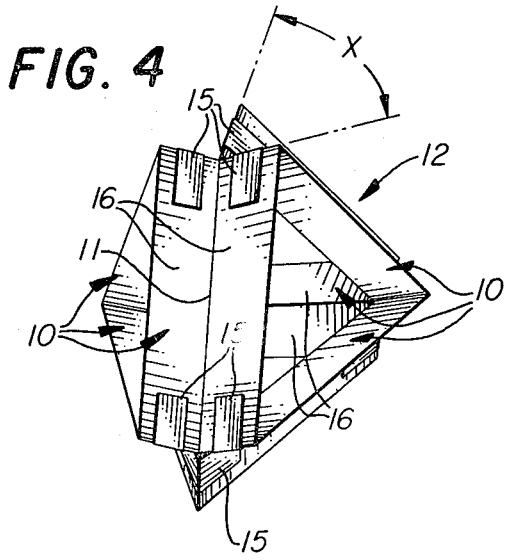
Figure 5:
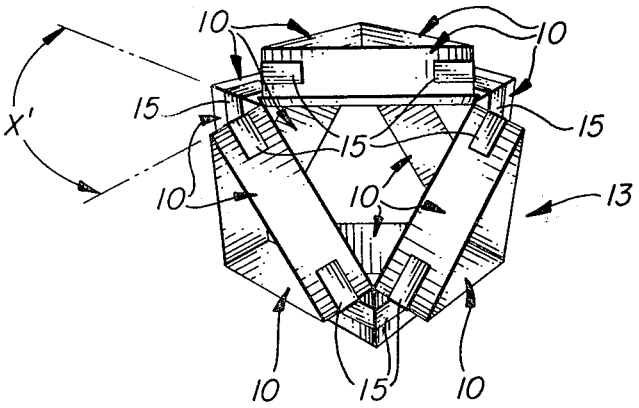

In the drawings:

FIG. 1 represents a folded rectangular truss element folded along its longitudinal center line;

FIG. 1A, a folded rectangular element formed of two rectangular structural sheets interconnected by a piano type interconnect hinge;

FIG. 2, interconnect detail between a set of adjacent end edges between two of the folded rectangular truss elements;

FIG. 2A, an alternate interconnect like that of FIG. 2 with, however, the set of adjacent end edges interconnected by a piano type interconnect hinge in place of the taped interconnect of FIG. 2;

FIG. 3, a structural triangle formed with three interconnected folded rectangular truss elements;

FIG. 4, a four sided tetrahedron built up with six interconnected folded rectangular truss elements; and, FIG. 5, on eight sided octahedron built up with twelve interconnected folded rectangular truss elements.

Referring to the drawings:

The rectangular folded sheet truss element 10 of FIG. 1 has a fold crease 11 along its longitudinal center to form an angled truss element of greater strength and a flat sheet (or sheets) of similar material. The included dihedral angle of the angled truss element between non-coplanar rectangular halves from fold crease 11 assumes an angle well under 180°, approximately an angle X of 110° with the truss element used in forming a four triangular faced tetrahedron 12, such as shown in FIG. 4, 90° with the truss element used in a cube while in the shape of a cube and not distorted one way or another since the cube interconnect structure tends to be unstable in not presenting the structural shape integrity attained inherently with truss elements used in triangular faced polyhedrals. The included dihedral angle of the angled truss element 10 approximates an angle X′ of 75° with the truss element used in forming an eight triangular faced octahedron 13, such as shown in FIG. 5, and approximately 42° included dihedral angle in the truss elements forming a twenty faced icosahedron (not shown). With the folded structural truss element 10 flexible at the fold crease 11, one basic truss element 10 may be used for the various polyhedrals mentioned and even polyhedrals with more triangular faces with, however, the included dihedral angle becoming progressively smaller by steps with each progressive step-up in the number of faces in closed polyhedral structures. If a particular polyhedral build-up is predetermined, then for such specific instances, the fold creased truss elements could be supplied with a specific included angle non-flexing crease dictated for that structure. The flexibly creased truss elements 10 are quite useful for educational purposes, and in structural game devices, in teaching basic structure building principles for various structural shapes and to illustrate mathematical concepts to students studying plane and solid geometry.

In the implementation of structural build-up of plurality of the folded truss elements 10 assembly is initiated with the fastening of an end edge 14 of one folded truss element 10 to an end edge 14 of another folded truss element 10 with an interconnect tape 15 spanning the adjacent ends 14 of respective folded halves 16 to provide a two element structural unit, as shown in FIG. 2. Each rectangular folded half 16 of a folded truss element 10 has end edges 14 disposed transversly of the fold crease line 11 of the truss element 10. The other folded halves 16 are still free for end 14 interconnection with other folded truss elements 10. A structural triangle is shown in FIG. 3 with three folded truss elements 10 having mutual end edge 14 interconnects with tapes 15 and the other folded halves 16 still free.

In the polyhedral 12 of FIG. 4 six folded truss elements 10 have end 14 and tape 15 interconnections such as to form a four triangular sided tetrahedron of great structural integrity and having an optimized strength-to-weight ratio. With this polyhedral tetrahedron 12 the included dihedral angle X of the angled truss elements approximates 110°. With the eight triangular sided octahedron 13 of FIG. 5 twelve interconnected folded rectangular truss elements 10 are required and the included dihedral angle X' of the fold angled truss elements approximates 75°. In a twenty triangular faced icosahedron (not shown) thirty folded truss elements 10 are required with the included dihedral angle of the fold angled truss elements approximating 42°.

With demonstration educational and/or game structures fold angled truss elements 10 may be of relatively stiff paper, cardboard or sheet plastic but foldable along crease 11 to the different included dihedral angles required in constructing polyhedrals with differing numbers of faces. It is surprising, however, the high degree of structural integrity attained with the angled truss elements used in constructing triangular faced polyhedrals. When greater structural strength and size are required a folded rectangular element 10' may be used, such as shown in FIG. (A) formed of two rectangular structural metal (or large stiff plastic) sheets 16' that are interconnected by a piano type interconnect hinge 11'. End edges 14 may be interconnected with heavy interconnect tapes, like tapes 15, or welded together in assembly for the particular structural shape constructed. Piano hinge 11' permits the angular articulation required in adaptation of the folded rectangular truss element 10' to the particular polyhedral being constructed. The angled folded truss elements 10'' illustrate a further interconnect variation between folded truss elements with folded halves 16 end edge piano hinge 14'' interconnections that use hinge rod 17 in place of tapes 15 or end edge welding. Please note that while not shown the longer piano hinge 11' uses a longer hinge rod like hinge rod 17. Thus, large useful structures having great structural integrity and optimized strength-to-weight ratios may be constructed using the larger heavier folded rectangular truss elements 10' or 10'' in addition to smaller educational and/or game demonstration sets and assembled structures. While the folded truss elements 10, 10' and 10'' have been described and shown as rectangular folded truss elements with each folded half 16 or 16' a rectangle itself, each folded half of a folded truss element could assume other sheet truss shapes for various structural truss building purposes as required. It should be noted that various polyhedral structural shapes provided may be provided with an outer (or inner, or both outer and inner covers) enclosure skins of plastic or other suitable material for protection of equipment contained therewithin, weather and/or temperature insulation protection as for radomes, container or modernistic housing, and other uses.

Whereas this invention is herein illustrated and described with respect to several embodiments hereof, it should be realized that various changes may be made without departing from essential contributions to the art made by the teachings hereof.

We claim:

1. A structural unit for use with other like structural units to form various stable polyhedral structures of three-dimensional shapes, each said unit consisting of a pair of truss elements, with each truss element being formed of a rectangular member and having a flexible fold crease line disposed centrally and longitudinally of said member and dividing said member into two substantially duplicate rectangular halves, each rectangular half of each said member being disposed in non-coplanar relation to the other rectangular half of the same said member; each rectangular half of said member having end edges disposed transversly of the fold crease line of said member; and with an end edge of only one of the rectangular halves of one of said pair of truss element members being secured by a interconnect means to an end edge of only one of the rectangular halves of the other of said pair of truss element members.

2. The structural unit of claim 1, wherein said interconnect means includes tape spanning the adjacent edge means and adhesion to two duplicate halves of interconnected first and second folded sheet truss elements.

3. The structural unit of claim 1, wherein said interconnect means is a solid non-flexing interconnect structure.

4. The structural unit of claim 1, wherein said fold crease is formed with a pivotal piano hinge type interconnection between said substantially duplicate halves.

5. The structural element of claim 4, wherein said interconnect means between adjacent end edges is a pivotal interconnect structure.

6. The structural element of claim 4, wherein said interconnect means includes adjacent end edge means pivotal piano hinge type interconnection of adjacent end edge means of first and second folded sheet truss elements.

* * * * *